US007800290B2

(12) United States Patent
Pullini et al.

(10) Patent No.: US 7,800,290 B2
(45) Date of Patent: Sep. 21, 2010

(54) HIGH EFFICIENCY EMITTER FOR INCANDESCENT LIGHT SOURCES

(75) Inventors: Daniele Pullini, Orbasano (IT); Piermario Repetto, Turin (IT); Leonid Doskolovich, Orbassano (IT); Stefano Bernard, Turin (IT); Vito Lambertini, Giaveno (IT); Piero Perlo, Sommariva Bosco (IT); Davide Capello, Turin (IT); Mauro Brignone, Orbassano (IT); Nello Li Pira, Fossano (IT)

(73) Assignee: C.R.F. Società Consortile per Azioni, Orbassano (Torino) (IT)

( * ) Notice: Subject to any disclaimer, the term of this patent is extended or adjusted under 35 U.S.C. 154(b) by 1167 days.

(21) Appl. No.: 10/534,389

(22) PCT Filed: Feb. 27, 2004

(86) PCT No.: PCT/IB2004/000563

§ 371 (c)(1),
(2), (4) Date: May 9, 2005

(87) PCT Pub. No.: WO2004/079773

PCT Pub. Date: Sep. 16, 2004

(65) Prior Publication Data

US 2006/0076868 A1 Apr. 13, 2006

(30) Foreign Application Priority Data

Mar. 6, 2003 (IT) ..... TO2003A0166

(51) Int. Cl.
*H01J 1/05* (2006.01)

(52) U.S. Cl. ..... 313/355; 313/311; 313/315

(58) Field of Classification Search ..... 313/315, 313/355, 578, 311

See application file for complete search history.

(56) References Cited

U.S. PATENT DOCUMENTS

| | | | | |
|---|---|---|---|---|
| 2,077,633 | A * | 4/1937 | McMaster et al. | 313/538 |
| 2,603,669 | A * | 7/1952 | Chappell | 373/88 |
| 3,956,660 | A * | 5/1976 | Ooms | 313/315 |
| 4,196,368 | A | 4/1980 | Hauer | |
| 4,499,398 | A * | 2/1985 | Munroe | 313/113 |
| 5,152,870 | A * | 10/1992 | Levinson | 216/44 |
| 5,416,376 | A * | 5/1995 | Wuest et al. | 313/93 |
| 6,281,629 | B1 * | 8/2001 | Tanaka et al. | 313/631 |
| 6,768,256 | B1 * | 7/2004 | Fleming et al. | 313/501 |
| 2002/0096107 | A1 * | 7/2002 | Fujishima et al. | 117/94 |
| 2002/0145385 | A1 * | 10/2002 | Perlo et al. | 313/522 |
| 2003/0132705 | A1 * | 7/2003 | Gee et al. | 313/569 |

FOREIGN PATENT DOCUMENTS

DE 198 45 423 4/2000

(Continued)

*Primary Examiner*—Joseph L Williams
*Assistant Examiner*—Fatima N Farokhrooz
(74) *Attorney, Agent, or Firm*—Nixon & Vanderhye P.C.

(57) ABSTRACT

An emitter (F) for incandescent light sources, in particular a filament, capable of being brought to incandescence by the passage of electric current is obtained in such a way as to have a value of spectral absorption $\alpha$ that is high in the visible region of the spectrum and low in the infrared region of the spectrum, said absorption $\alpha$ being defined as $\alpha=1-\rho-\tau$, where $\rho$ is the spectral reflectance and $\tau$ is the spectral transmittance of the emitter.

27 Claims, 7 Drawing Sheets

FOREIGN PATENT DOCUMENTS

| | | | |
|---|---|---|---|
| EP | 1 249 856 | | 10/2002 |
| GB | 2032173 | * | 10/1978 |
| GB | 2 032 173 | | 4/1980 |
| WO | WO 2004/021451 | | 3/2004 |
| WO | WO 2004/079774 | | 9/2004 |

* cited by examiner

HIGH EFFICIENCY EMITTER FOR INCANDESCENT LIGHT SOURCES

This application is the US national phase of international application PCT/IB2004/000563 filed 27 Feb. 2004 which designated the U.S. and claims benefit of IT TO2003A000166, dated 6 Mar. 2003, the entire content of which is hereby incorporated by reference.

FIELD OF THE INVENTION

The present invention relates to an emitter for incandescent light sources, in particular shaped as a filament or a plate, capable of being brought to incandescence by the passage of electric current.

BACKGROUND OF THE INVENTION

As is known, traditional incandescent lamps are provided with a tungsten (W) filament which is made incandescent by the passage of electric current. The efficiency of traditional incandescent lamps is limited by Planck's law, which describes the spectral intensity $I(\lambda)$ of the radiation emitted by the tungsten filament of the lamp at the equilibrium temperature T, and by heat losses through conduction and convection. The energy irradiated by the tungsten filament in the visible range of the electromagnetic spectrum is proportional to the integral of the curve $I(\lambda)$ between $\lambda_1$=380 nm and $\lambda_2$=780 nm, and is at the most equal to 5-7% of the total energy.

According to Kirchoff's law, under thermal equilibrium conditions the electromagnetic radiation absorbed by a body at a specific wavelength is equal to the electromagnetic radiation emitted. A direct consequence of this law is that the spectral emittance "$\epsilon$" of a surface coincides with spectral absorbance "$\alpha$". Spectral absorbance "$\alpha$" in turn is linked to spectral reflectance "$\rho$" and to spectral transmittance "$\tau$" through the relationship $\alpha=1-\tau-\rho$ whence descends the relationship $1-\epsilon=\tau+\rho$. For an opaque material, $\tau$ is substantially nil and spectral reflectance $\rho$ coincides with $(1-\epsilon)$; note, however, that any material, for sufficiently small thickness values, has a spectral transmittance $\tau$ different from 0.

The relationship $\tau+\rho=1-\epsilon$ implicitly states that, if the surface of an opaque body has a low spectral reflectance at a given wavelength, the corresponding spectral emissivity will be very high; vice versa, if spectral reflectance is high, the corresponding emissivity will be low.

Emissivity, absorbance, transmittance and reflectance are functions, not only of wavelength, but also of temperature T and of the angle of incidence/emission $\theta$, but the above relationships hold true for any T, any wavelength and any angle, since they descend from pure thermodynamic considerations. In general, the relationship $\tau+\rho=1-\epsilon$ can thus be rewritten as $$\tau(\lambda,T,\theta)+\rho(\lambda,T,\theta)=1-\epsilon(\lambda,T,\theta).$$

The curves of reflectance and spectral transmittance at a given temperature T, from which descend the values of absorbance and emissivity at that temperature, can be calculated a priori through the optical constants (always at temperature T) of the material or of the materials constituting the emitter for any geometry of the emitter and for any angle of incidence/emission.

The optical constants of the material are the real value n and the imaginary value k of the refraction index; the values of n and k for most known materials have been measured experimentally and are available in the literature. In general, there are no values of n and k available at the temperatures of interest for incandescent sources. The reflectance and transmittance calculation, presented in the remainder of the description and in the related figures, refer to optical constants measured at ambient temperature; however, the above considerations have general validity and can easily be transferred to the case of high temperatures.

In a traditional incandescent source, radiation is emitted by a tungsten filament, whose operating temperature is around 2800K; the emitted radiation follows the law of the black body, whose corresponding spectrum is given by Planck's relationship. The filament can be considered, with good approximation, a grey body, i.e. with constant emissivity throughout the spectrum of interest. By definition, a black body is a grey body with emissivity $\epsilon(\lambda, T, \theta)$ independent of $\lambda$ and of $\theta$ and equal to 100% (maximum value). The emission spectrum of a grey body can be obtained multiplying the black body spectrum $I(\lambda)$ (given by Planck's relationship) for an emissivity value of $\epsilon(T)$ For a non-grey body, Planck's curve Planck $I(\lambda)$ must instead be multiplied times a spectral emissivity curve $\epsilon(\lambda, T, \theta)$.

The spectral emissivity of tungsten is generally a function of temperature; it has been demonstrated empirically that the mean emissivity of tungsten follows the relationship $$\epsilon_m(T)=-0.0434+1.8524*10^{-4}*T-1.954*10^{-8}*T^2.$$

At low temperatures the spectral emissivity curve can easily be derived measuring the reflectance spectrum of tungsten and applying the relationship $\epsilon(\lambda, T, \theta)=1-\rho(\lambda, T, \theta)$; at incandescence temperatures, this type of measure becomes unfeasible, because the spectrum of reflectance and the spectrum of emission are obviously mixed.

At the temperature of 2800K, the mean emissivity of tungsten is about 30%, which corresponds to a mean reflectance of about 70%. At 2800K, the peak in the emission spectrum is at a wavelength slightly greater than 1 micron, which presupposes that most of the radiation is emitted in the form of infrared.

In particular for a grey body at a temperature of 2800K, slightly less than 10% of radiation is emitted in the visible spectrum (380-780 nm), whilst over 20% is emitted in near infrared (780-1100 nm).

In fact, the tungsten filament is not an actual grey body, but it has a spectral emissivity that is more or less constant in the visible spectrum, and tends significantly to decrease in near infrared, as is readily apparent from the reflectance and spectral emissivity curves shown in FIG. 1. In the graph of FIG. 1, the curves CRW and CEW respectively represent the reflectance and the emissivity of tungsten at ambient temperature for different wavelengths in the visible and near infrared spectrum.

This causes the efficiency of a tungsten filament, i.e. the ratio between visible radiation and total emitted radiation, is far greater than that of a grey body; the advantage is still more significant when considering the spectral emissivity at ambient temperature. FIG. 2 compares the Planck's curve at 2800K, designated CP, with the spectral power emitted by a tungsten filament at 2800K; for tungsten, the chart shows both the experimentally measured values (curve PM), and the values calculated using the optical constants of tungsten at ambient temperature (curve PC).

According to U.S. Pat. No. 4,196,368, the efficiency of a light bulb can be improved by modifying the surface microstructure of an incandescent filament, so as to increase emissivity in the visible region of the spectrum and/or suppress the emission of energy outside the visible region of the spectrum; a similar solution is also disclosed by DE-A-198 45 423.

Another way suggested in U.S. Pat. No. 4,196,368 for improving efficiency is to coat the filament with a thin refractory material, to suppress filament evaporation. Similarly, in order to prevent or reduce blackening of a lamp envelope due to evaporation of material from the filament of an incandescent lamp, GB-A-2 032 173 suggests coating the filament with a refractory or ceramic material.

SUMMARY OF THE INVENTION

Based on the above, the present invention aims to provide an emitter for incandescent sources, capable of being brought to incandescence by a passage of electric current, having a higher efficiency than filaments for incandescent lamps obtained with traditional techniques.

The term "efficiency of the light source" means the ratio between the visible component (i.e. the component between 380 nm and 780 nm) of the electromagnetic radiation and the sum between the visible component and the near infrared component (i.e. the component between 780 nm and 2300 nm).

This object is achieved by an emitter for incandescent light sources, capable of being brought to incandescence by the passage of electrical current, provided with means for maximising absorbance $\alpha(\lambda)$ for $\lambda$ belonging to the visible region of the spectrum and minimising absorbance $\alpha(\lambda)$ for $\lambda$ belonging to the infrared region of the spectrum, in such a way that, at equal operating temperature T, the ratio between the radiation emitted in the visible region of the spectrum and the radiation emitted in the infrared region of the spectrum of the emitter is greater than the same ratio for a tradition incandescent filament.

The aforesaid means comprise a nanostructure formed on at least one surface of the emitter, comprising an ordered series of micro-projections and/or of micro-cavities and permanently encapsulated in a dielectric matrix of refractory material, such as alumina, yctria, zirconia, or any other oxide with high melting point.

The nanostructuring of the emitter surface is aimed at obtaining a relative increase in emissivity (or decrease in reflectance) in the visible region of the spectrum, to a greater extent than the relative increase in emissivity (or decrease in reflectance) in the infrared region of the spectrum.

The aforesaid matrix of refractory oxide, instead, has the dual function of:

i) limiting the atomic evaporation of the material constituting the emitter, or its nanostructure, at high operating temperature, responsible for the "notching" effects of the emitter, which shorten its working life under operating conditions, and also for the nanostructure flattening effects; said evaporation, which is the greater the hither the operating temperature, would tend to flatten the superficial structure of the emitter, reducing its performance over time and its benefits in terms of efficiency increase;

ii) maintaining the morphological structure of the emitter, or of its nanostructure, even if the material which constitutes it undergoes a state change, in particular melting, due to its use under conditions of operating temperature exceeding its melting point.

The aforementioned item ii) has a particular importance because it allows to use materials having, in the presence or absence of superficial structuring, a spectral emissivity that is particularly high in the visible region and low in the infrared, even at operating temperatures exceeding the melting point; for such materials, in spite of the good spectral emissivity properties, luminous efficiency would otherwise be limited by their use at low temperature (as is well known, the visible component emitted by a grey body grows as temperature grows, reaching the maximum point at T of about 6000K, the surface temperature of the Sun).

To increase the spectral absorption of the emitter in the visible region and minimise spectral absorption in the infrared region, the choice of the material whereof the emitter is made is at least as important as the morphology of the micro-structure obtained on the emitter.

Purely by way of example, a material such as gold has a spectral emissivity at room temperature that is particularly suited to obtain an efficient emitter, since spectral reflectance in the near infrared region is very high and drops suddenly in the visible region of the spectrum (hence the yellow colour, due to high absorption in the blue portion). In this regard, see FIG. 1 where the curve CRAu represents the reflectance of a gold foil, which is sharply higher than planar tungsten as per curve CRW in the near infrared region, and with a much more sudden drop in the visible region with respect to tungsten; in said FIG. 1, the curve CEAu represents the emissivity of the same gold foil. The efficiency (as previously defined) of a planar tungsten emitter at 2000K is about 6%, whilst that of a planar gold emitter is about 8% (superficial temperature or 2000K, greater khan the melting point of gold).

As stated, the solution according to the present invention consists of structuring the surface of the emitter, which is preferably in plate form with parallel faces, but can also be in the form of a wire, cylindrical or with any other cross section, with the three-dimensional micro-structure having periodicity below the visible wavelength and such as to increase absorption selectively, mainly in the visible region of the spectrum. This allows, at equal equilibrium temperature, to increase the portion of radiation emitted in the visible region, increasing the portion emitted in the infrared region to a lesser extent than the visible portion and thereby enhancing the luminous efficiency of the emitter. In general terms, the dimensions of the emitter according to the invention, both in terms of total thickness and of depth/height of the micro-projections or of the micro-cavities, are in the order of tens or hundreds of nanometres. The size and periodicity of the micro-structure are determined according to the real and imaginary retraction index of the material used, to the operating temperature and to the spectral reflectance curve to be obtained.

It should be observed that the spectral reflectance curve depends not only on the structure of the anti-reflection grating provided, but also on the angle of incidence and polarisation of the light. The anti-reflection micro-structure according to the invention can be optimised as a function of a specific angle of incidence (typically, normal incidence) and of a polarisation state, which means that the reflectance curve will in fact be optimised only for one specific angle of incidence. However, the grating can be optimised, in terms of pitch, height and shape of the micro-projections or of the micro-cavities, in such a way as to minimise the angular sensitivity of the grating.

Specific preferred characteristics of the invention are set out in the appended claims, which are understood to be an integral part of the present description.

BRIEF DESCRIPTION OF THE DRAWINGS

Additional objects, characteristics and advantages of the invention shall become readily apparent from the description that follows, made with reference to the accompanying drawings, provided purely by way of non limiting examples, in which.

DETAILED DESCRIPTION OF THE INVENTION

As previously explained, according to the main aspect of the present invention, the increase in efficiency of visible emission is obtained by means of an appropriate micro-structuring of the surface of the incandescence emitter; said micro-structuring is operative to reduce the reflectance ρ in the visible region of the spectrum, reducing the reflectance ρ in the near infrared region to a lesser extent, in order to increase emission efficiency in the visible region.

The desired anti-reflection behaviour can be obtained both with a one-dimensional grating, i.e. with periodic projections along a single direction on the surface of the filament, both with a two-dimensional diffraction grating, i.e. with periodic projections along two orthogonal directions, not being necessarily parallel to each other, on the surface of the filament. For this purpose, in FIG. 3 the reference F designates a portion of an emitter according to the invention, which superficially has a diffraction grating R formed by periodic micro-projections R1 along a single direction; in the case shown in FIGS. 4 and 5, instead, the portion F of emitter according to the invention superficially has a diffraction grating R formed by periodic micro-projections R2 along two orthogonal directions. It should be noticed that the anti-reflection structure R could have also different symmetries, such as a rhombic, hexagonal or any other type of symmetry.

Figure 1:
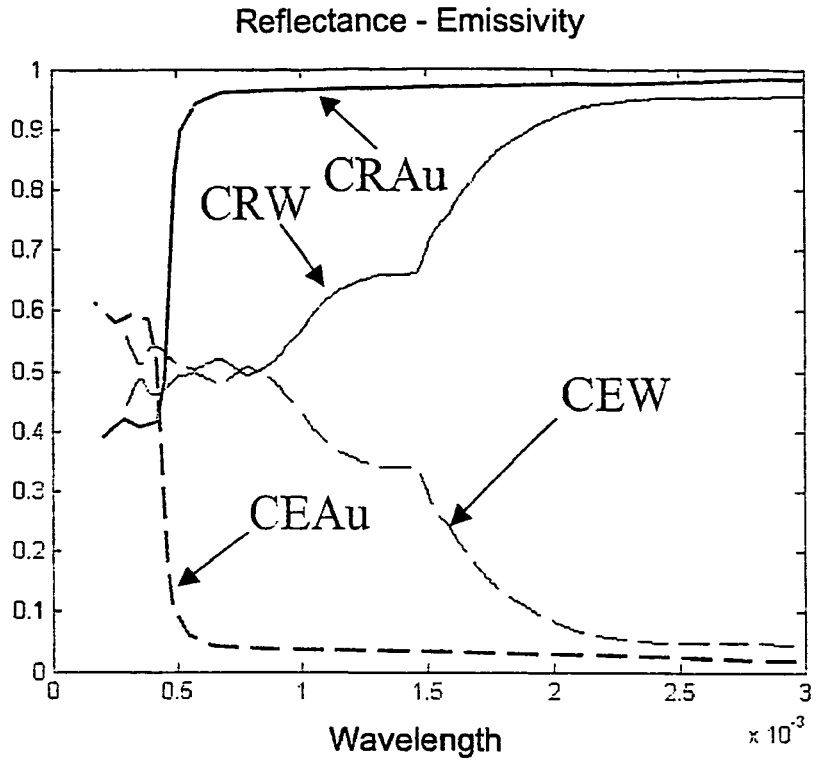
FIG. 1 is a chart which represents la reflectance (curve CRW) and the emissivity (curve CEW) of tungsten at ambient temperature for different wavelengths in the visible and near infrared spectrum, compared with the spectral reflectance (curve CRAu) and emissivity (curve CEAu) of gold.
Figure 2:
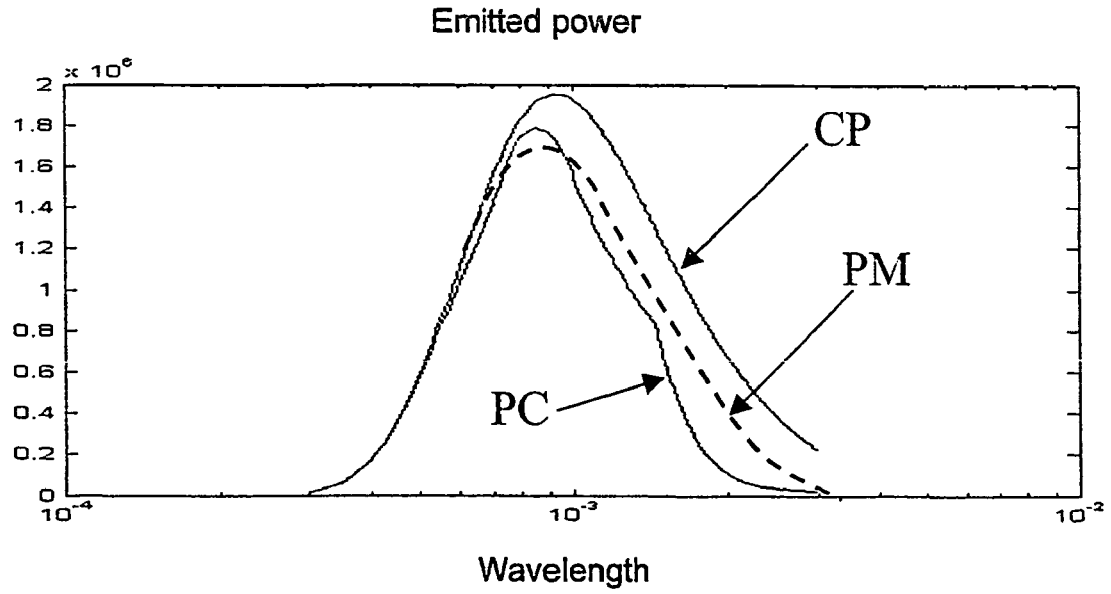
FIG. 2 is a chart which compares Planck's curve at 2800K (curve CP) to the spectral power emitted by a tungsten filament at 2800K; for tungsten, the chart shows both experimentally measured values (curve PM), and the values calculated using the optical constant of tungsten at ambient temperature (curve PC)
Figure 3:
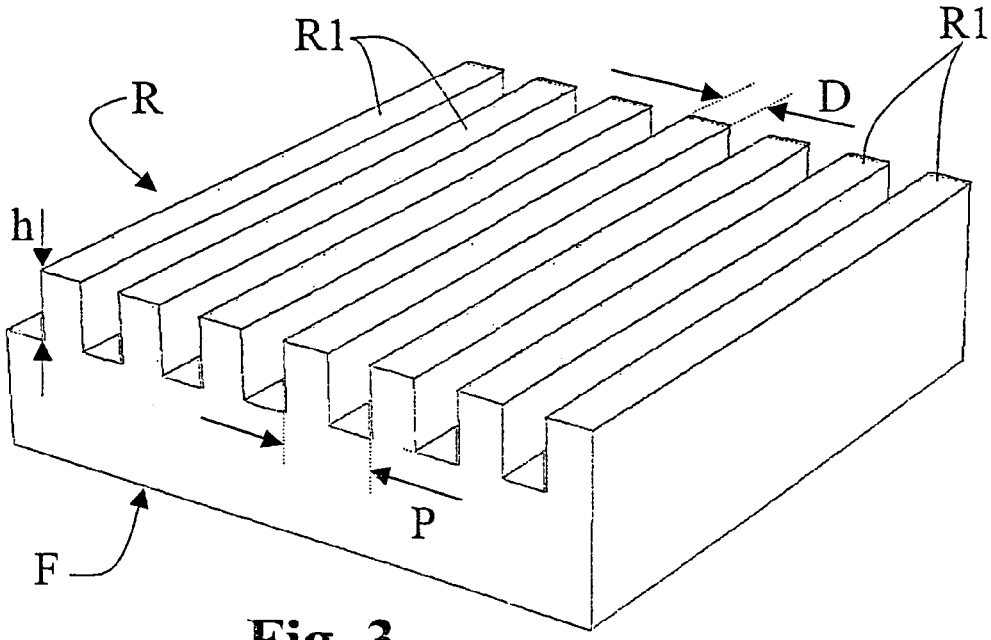
FIG. 3 is a schematic perspective representation of a portion of an emitter superficially provided, according to the invention, by a one-dimensional diffraction grating, i.e. with periodic projections along a single direction.
Figure 4:
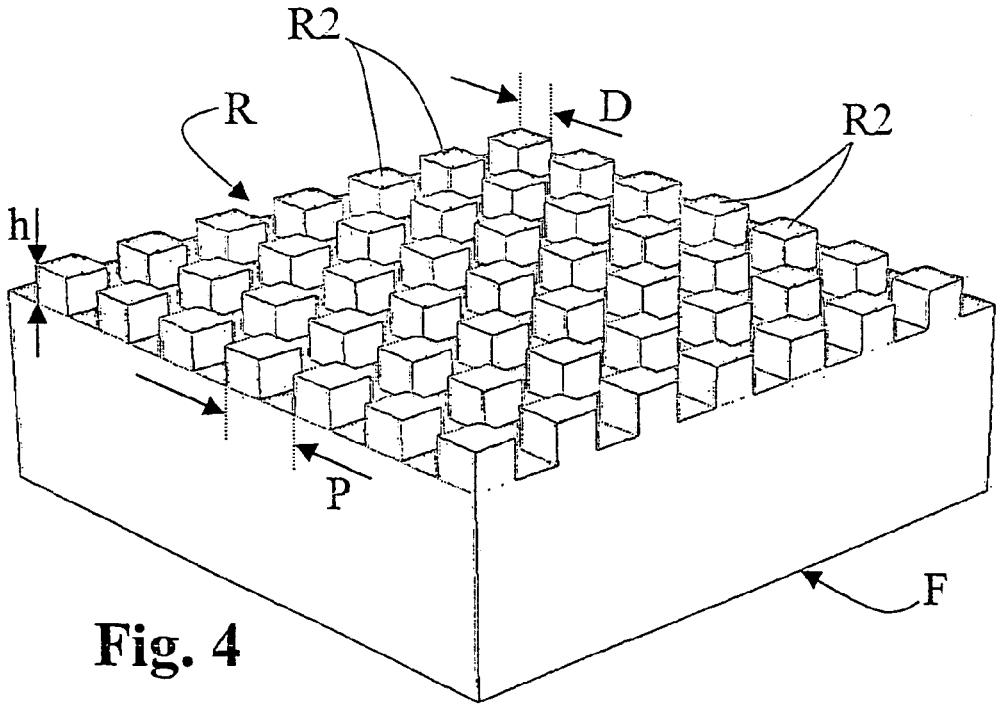
FIGS. 4 and 5 are schematic perspective representations of respective portions of two emitters according to the invention, superficially provided with a respective two-dimensional diffraction grating, i.e. with periodic projections along two orthogonal directions on the surface of the emitter.
Figure 5:
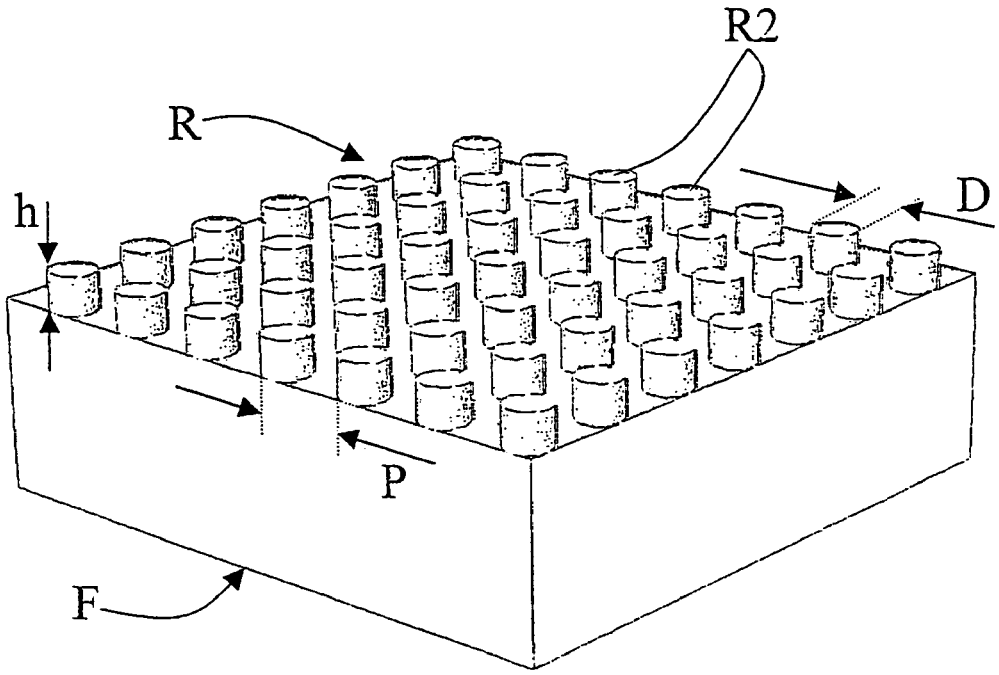

In FIGS. 3-5, the reference h designates the depth or height of the projections R1, R2, the reference D designates the width of the projections and P the period of the grating R; the filling factor of the grating R is defined as the ratio D/P in the case of FIG. 3, as the ratio $D^2/P^2$ in the case of FIG. 4 and as the ratio $\pi D^2/(4P^2)$ in the case of FIG. 5.

Figure 6:
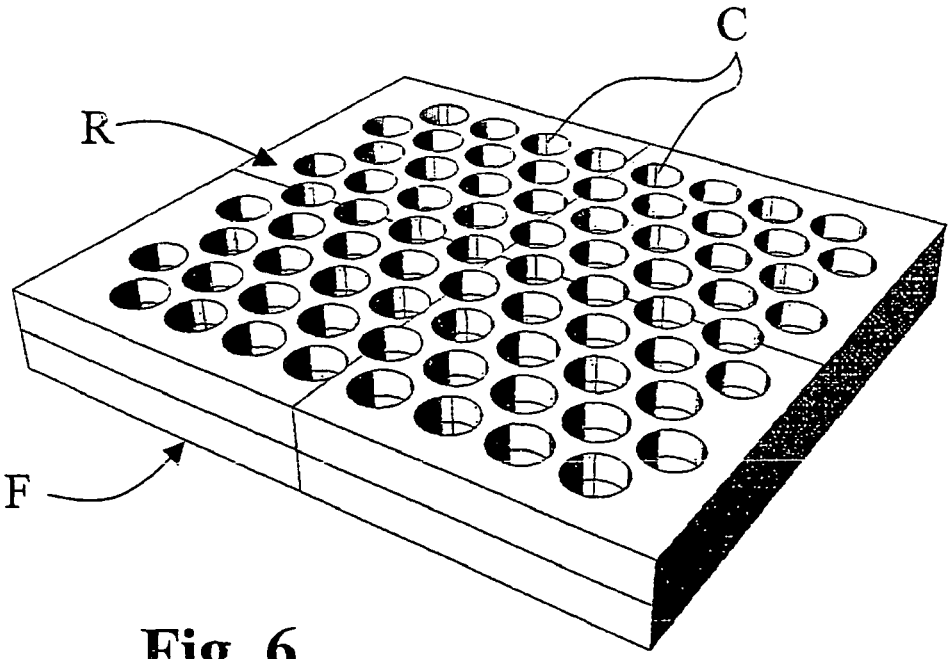
FIG. 6 is a schematic perspective representation of a portion of a further emitter according to the invention, superficially provided of a two-dimensional diffraction grating with rhombic symmetry, formed by periodic cavities along two not orthogonal directions on the surface of the emitter.

FIG. 6 shows a portion F of an emitter according to the invention whose superficial diffraction grating R is instead formed by micro-cavities C periodic along two orthogonal directions, being not necessarily parallel to each other; in substance, the anti-reflection structure as proposed in FIG. 6 has a shape that is complementary to the shape of the structure shown in FIG. 5.

In general, the anti-reflection grating according to the invention can also be multi-level or with continuous profile, which allows to increase the degrees of freedom to optimise the grating and further enhance efficiency.

According to a further important aspect of the invention, the diffraction grating R is permanently encapsulated in a layer of refractory oxide, for instance yttrium oxide; the presence of said layer of oxide has many advantages:

- it enables further to enhance the efficiency of the emitter, itself acting as an anti-reflection coating able to complement the anti-reflection characteristics of the diffraction grating R;
- it can enable to operate the filament under less pronounced vacuum conditions or, in principle, even in air without encountering phenomena of oxidation of the emitter F;
- both under vacuum and inert gas atmosphere conditions, the presence of the oxide coating allows to reduce the evaporation rate of the material constituting the emitter, and hence extend the average life of the source and preserve the shape of the micro-structure R;
- it allows to use materials whose optical constants are better suited for the manufacture of high efficiency emitters, such as gold, even at operating temperatures exceeding the melting point of the material itself (but still lower than the melting point of the refractory oxide) encapsulating said materials and assuring that the structural morphology of the emitter F is maintained.

Figure 7:
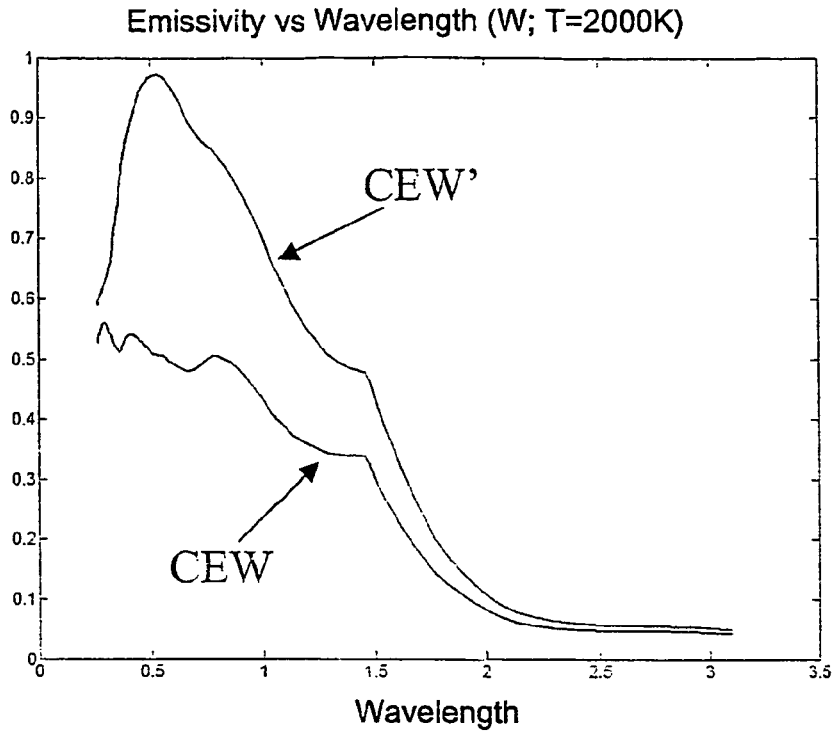
FIG. 7 is a chart comparing the spectral emissivity of planar tungsten (curve CEW) and that of tungsten nanostructured with a grating of the kind shown in FIG. 3 (curve CEW')
Figure 9:
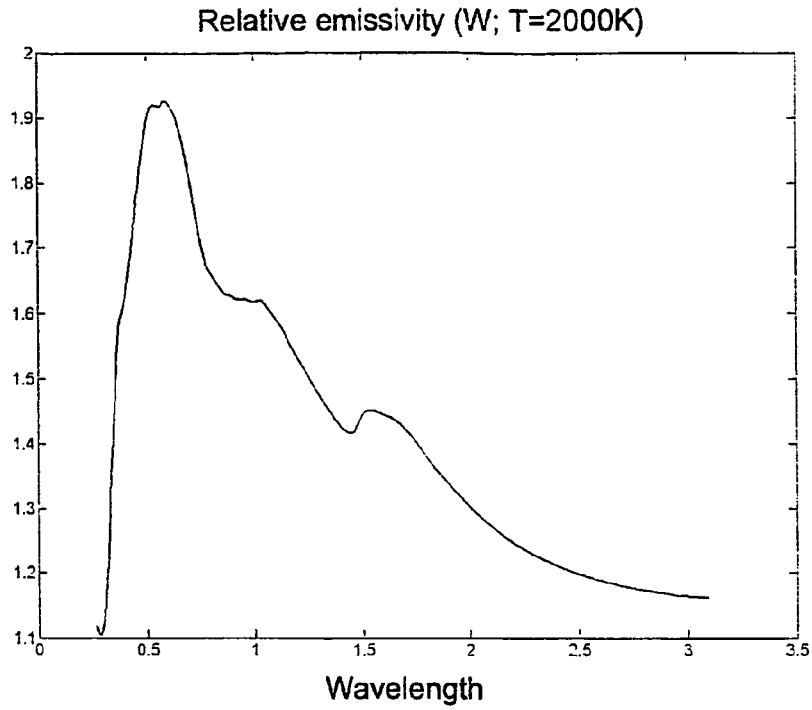
FIG. 9 is a chart showing the relative increase in spectral emissivity as a function of wavelength for a tungsten emitter nanostructure with a grating of the kind shown in FIG. 3.

From the preceding description, and from FIGS. 7 and 9 (where the curve CEW represents the spectral emissivity of planar tungsten and the curve CEW' that of tungsten nanostructured according to the invention), it is readily apparent that, by virtue of the anti-reflection nanostructuring of the emitter F, at equal operating temperature T, the ratio between the radiation emitted in the visible region of the spectrum and the total radiation emitted in the visible and infrared region of the spectrum for an emitter according to the invention is greater than the same ratio with respect to the case of a traditional incandescent filament, with obvious advantages in terms of light source efficiency. In particular, given that the proposed emitter has a respective spectral absorbance $\alpha(\lambda,T)$ at an operating temperature T and for a wavelength $\lambda$, (where absorbance is linked to spectral reflectance $\rho(\lambda,T)$ and to spectral transmittance $\tau(\lambda,T)$ by the relationship $\alpha(\lambda)=1-\rho(\lambda,T)-\tau(\lambda,T)$), the anti-reflection structure R enables to maximise absorbance $\alpha(\lambda)$ for $\lambda$ belonging to the visible region of the spectrum, whereas absorbance $\alpha(\lambda)$ for $\lambda$ belonging to the infrared region of the spectrum is increased by a lesser extent.

The proposed microstructure R according to the invention is therefore suitable to modify the spectral emissivity of the emitter F, increasing the portion of emitted visible light, and hence the luminous efficiency of the lamp or light source which incorporates said emitter. In this view, the micro-projections R1, R2 or the micro-cavities C will be conceived to maximise the electromagnetic emission in the visible spectrum from emitter F, without reducing and, in fact, possibly increasing reflectance in other spectral regions.

As explained above, the operation of the microstructure R is based on Kirchoff's law, according to which under thermal equilibrium conditions the electromagnetic radiation absorbed by a body at a specific wavelength is equal to the emitted electromagnetic radiation. A direction consequence of this law is that if the surface of a body has low spectral reflectance at a given wavelength, the corresponding spectral emissivity will be very high; vice versa, if spectral reflectance is high, the corresponding emissivity will be low.

The dependence of spectral reflectance on the angle and on the polarisation state impacts on a similar angular dependency of spectral emissivity, based on the above considerations. Thus, considering the radiation emitted by the superficially micro-structured emitter according to the invention, at a specific wavelength, the corresponding emission lobe will not be Lambertian (constant radiance, as in the case of unstructured source), but will follow the angular behaviour of the grating given by the microstructure R. The emitted radiation, moreover, will have a degree of polarisation and coherence, unlike the radiation emitted by an incandescent source according to the prior art.

The advantages described above can be obtained to a greater extent by means of nanostructured emitters constructed with materials having more favourable optical constants than tungsten.

Figure 8:
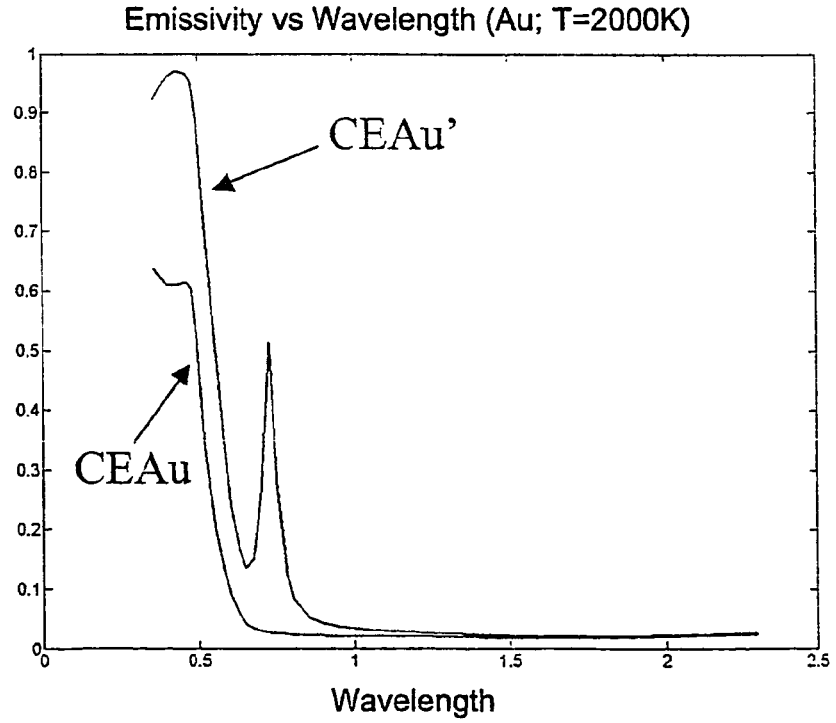
FIG. 8 is a chart comparing the spectral emissivity of planar gold (curve CEAu) and that of gold nanostructured with a grating of the kind shown in FIG. 3 (curve CEAu')
Figure 10:
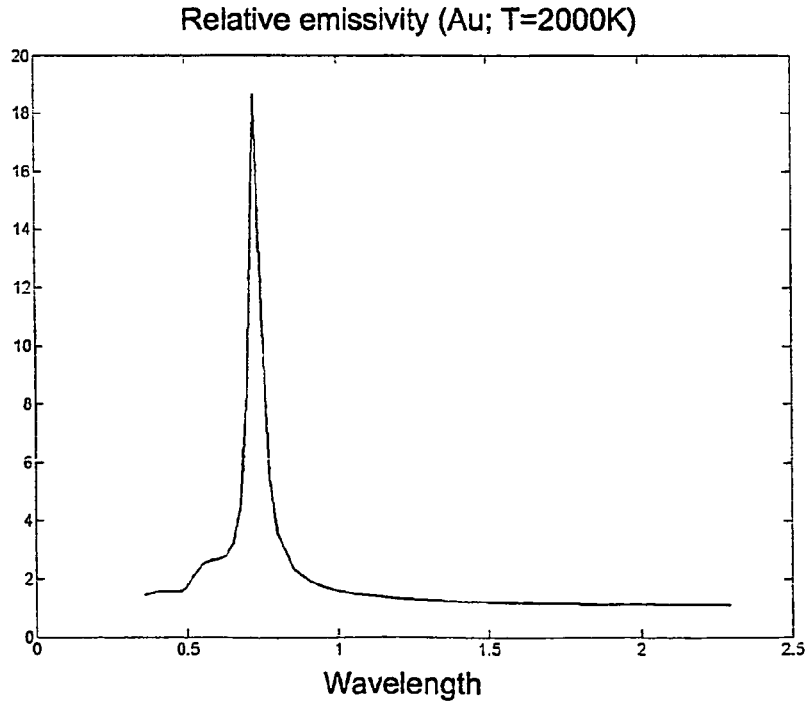
FIG. 10 is a chart showing the relative increase in spectral emissivity as a function of wavelength for a gold emitter, nanostructured with a grating of the kind shown in FIG. 3.

In this regard see, for example, FIG. 8, in which the spectral emissivity of planar gold (curve CEAu) is compared to that of gold nanostructured with a grating R according to the invention, and FIG. 10, which shows the relative increase in spectral emissivity as a function of wavelength for a gold emitter nanostructured according to the invention.

On this point it should be recalled that many materials with lower melting points than tungsten, such as gold, silver, copper, have more advantageous emissive properties than tungsten, although their low melting point normally precludes their use at operating temperatures where visible emission is efficient (>1500K); as stated previously, to obtain an advantageous black body emission (i.e. one with a greater visible emission), the body must be taken to the highest possible temperatures (maximum efficiency above 5000K). In the case of emitter materials with low melting point, the material itself can melt or at least be deformed as the current that brings to incandescence passes, which would entail the loss of the grating shape capable of enhancing emission efficiency, until the emitter is completely destroyed.

In the preferred embodiment of the invention, therefore, a refractory oxide is used to encapsulate the filament provided with the grating, In such a way that the softening or even the passage to the liquid state of the nano-structured conductor material does not entail the destruction of the grating, and ultimately of the emitter. The refractory oxide, which is non deformable at the temperature of incandescence of the emitter (1500K-2000K depending on the material) in fact constitutes a complementary matrix to the anti-reflection grating and it is therefore capable of maintaining the shape thereof even if the material constituting the emitter is deformed or liquefied. In this way, the performance of the grating is assured and the behaviour of the a priori designed emission is maintained, as explained above.

In accordance with the aforesaid preferred embodiment, the emitter or a part thereof is made with a conductor or semiconductor with low melting point, but having optical constants that are suitable significantly to enhance the efficiency of the emitter through an appropriate nanostructuring. Conductor material of particular interest in this sense are for instance gold, silver and copper.

As is readily apparent from a comparison between FIGS. 7-8 and 9-10, the effects of the superficial microstructure of the emitter on efficiency enhancement are definitely more significant in gold than in tungsten. The efficiency of a tungsten emitter, appropriately structured and coated by yttrium oxide, at 2000K is almost 8% (i.e., 20% relative increase), whilst a structured gold emitter, encapsulated in yttria to be able to maintain its structural morphology even above the melting point, increases its efficiency with respect to planar gold by over 200%, achieving an efficiency of 25%.

Figure 11:
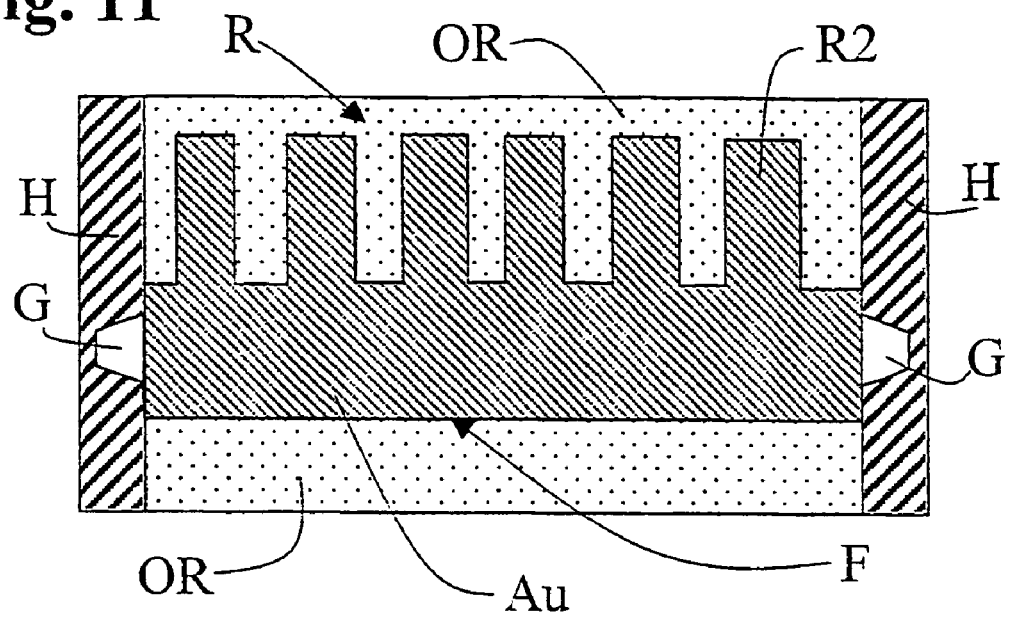
FIGS. 11 and 12 are schematic sectioned representations of respective portions of emitters in accordance with two preferred embodiments of the invention, superficially provided with a respective two-dimensional diffraction grating and encapsulated in a refractory oxide.
Figure 12:
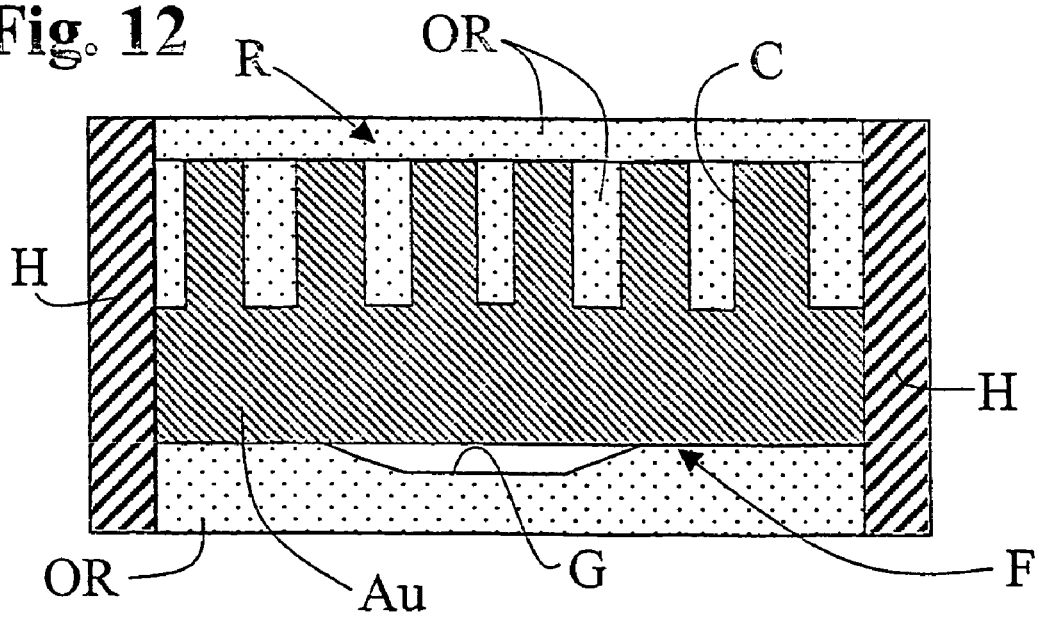

FIGS. 11 and 12 are partial and schematic representations of two emitters F according to the preferred embodiment described above, which extend between respective electrodes H.

In the case of FIG. 11, the emitter F has an anti-reflection structure R of the type shown in FIG. 5, constituted by substantially cylindrical micro-projections or pillars R2, whilst in the case of FIG. 12 the structure R is of the type shown in FIG. 6, constituted by micro-cavities C having circular cross section. The emitter F is structured in such a way as to obtain a two-dimensional phase grating, for instance made of gold, in which the electrical current that induces incandescence passes. The electrodes H are instead made of a high melting point conductor material, such as tungsten and the like, or semiconductor material, such as carbon and the like.

The low melting point material of the emitter F traversed by current reaches high temperature; for example, in the exemplified case, in which the material of interest is gold, the radiation is emitted by the emitter at an operating temperature around 1900-2000 degrees Kelvin. As previously explained, at such temperatures a gold grating would be liquefied. According to the preferred embodiment, therefore, the layer of refractory oxide is provided, designated by the reference OR in FIGS. 11 and 12, which fully coats the emitter F, following its profile in its structured part R; in other words, the refractory oxide R is the perfect female 8 in the case of structure with micro-projections R2) or the perfect male (in the case of structure with micro-cavities C) of the grating R.

The oxide OR with high melting temperature can for instance be a ceramic base oxide, thorium, cerium, yttrium, aluminium, zirconium oxide.

When the metallic grating R is deformed and/or melted, the oxide matrix OR preserves the phase profile of the grating R, i.e. assures that Its shape is maintained, even if the material constituting the emitter reaches the liquid state.

In a particularly advantageous embodiment, one or more throats or cavities G are provided, open on the material of the emitter F, for example in correspondence with one or both electrodes as schematically shown in FIG. 11, or within the refractory oxide structure, as schematically shown in FIG. 12. Such cavities or throats G are provided to be filled by the material of the emitter F whose volume can expand at high temperatures; said throats G therefore serve to prevent delamination phenomena between the oxide OR and the material of the emitter F, as well as ruptures of the device.

In the various proposed implementations, the micro-structure R can be obtained directly from the material that constitutes the emitter F.

A first possible method provides for the construction of a template made of porous alumina (porous aluminium oxide). For this purpose an aluminium film, with a thickness in the order of a micron, is plated by means of sputtering or thermal evaporation onto a suitable substrate, for example made of glass of silica, and it is subsequently subjected to an anodisation process.

The process of anodising the aluminium film can be carried out using different electrolytic solutions depending on the size and distance of the alumina pores to be obtained.

The layer of alumina obtained by means of the first anodisation of the aluminium film has an irregular structure; to obtain a highly regular structure, it becomes necessary to carry out successive anodisation processes, and in particular at least i) a first anodisation of the aluminium film;

ii) a step of reducing, by etching the irregular alumina film, conducted by means of acid solutions (such as $CrO_3$ and $H_3PO_4$);

iii) a second anodisation of the aluminium film starting from the residual part of alumina not eliminated by means of etching.

The etching step as per item ii) above is important to define on the residual part of irregular alumina preferential areas of growth of the alumina itself in the second anodisation step.

Conducting the successive operation of etching and anodising several times enables the porous alumina structure to improve until becoming highly uniform.

Once the regular alumina template is obtained, it is infiltrated with the desired emitter material, for example by means of magnetron sputtering (DC or RF), i.e. in such a way that the alumina structure serves as a mould for the structured area of the emitter F.

In the case of a tungsten emitters the alumina structure can subsequently be eliminated in such a way as to be replaced with a refractory oxide whose melting point is higher than alumina and which can be plated by means of RF sputtering. Vice versa, in the case of an emitter made of material with low melting point and if the operating temperature of the filament is kept below the melting temperature of alumina, the alumina structure, which is transparent, can be maintained, in order to assure that the shape of the grating R will be maintained at the operating temperatures of the emitter itself; in this case, on the wart of the emitter F that is not structure and protected by the porous alumina will be plated a refractory oxide, in order to provide a globally closed container of the emitter material.

Another possible manufacturing process starts from a filament, or from a planar lamina of the selected material, and etch the microstructure R under wavelength using any one of the known nanopatterning methods (electronic beam, or FIB or simple advanced photo lithography). In the case of material with low melting point, the emitter thus obtained will be coated by refractory oxide, for instance by means of sputtering, CVD, electroplating.

In other embodiments, the emitter F according to the invention can be formed with multiple, mutually different materials. For instance, as in FIG. 13, the basic material of the emitter can be a conductor with high melting point, for instance tungsten, designated as W, with the microstructure R obtained directly on said material; on said micro-structure is provided a thin and uniform coating of conductor or semiconductor material with low melting point and having more advantageous optical characteristics than tungsten, such as gold, designated by the reference Au; the coating Au allows to maintain the profile of the micro-projection R, whilst exploiting the more favourable emissivity properties of gold; the layer of refractory oxide OR enables to preserve the shape of the structure under conditions of operating temperature exceeding the melting temperature of the layer with low melting point Au. This embodiment also can be provided with a layer of refractory oxide OR on the layer of material W with high melting point, in order to prevent its evaporation and/or oxidation.

Figure 14:
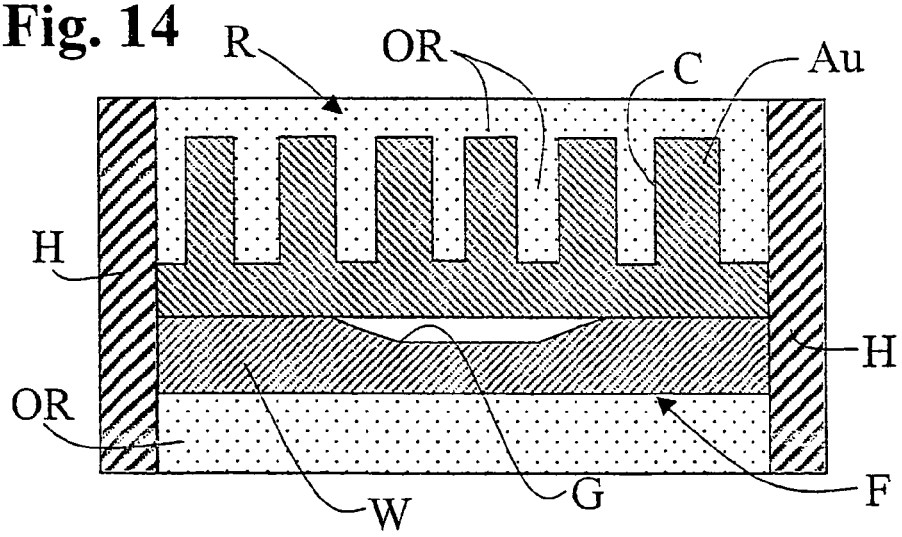
FIG. 14 is a schematic representation of an emitter according to the invention in which the nanostructuring is formed in a layer (Au) made of material with low melting point, such as gold, silver copper, which is deposited onto a planar substrate (W) of material with high melting point, such as tungsten, and also encapsulated, at least superiorly, in a layer of refractory oxide (OR)

In an additional preferred configuration, shown in FIG. 14, the micro-structure R can be obtained on a layer of conductor or semiconductor material with low melting point, advantageous from the optical point of view, such as gold, designated by the reference Au, with said layer Au bearing the grating R obtained on a layer of conductor material with high melting point, such as tungsten, indicated by the reference W; in this embodiment, a first layer OR of refractory oxide allows to preserve the shape of the microstructure R in conditions of operating temperature exceeding the melting temperature of the layer with low melting point Au in which the microstructure itself is formed. In this case, too, a second layer of refractory oxide OR can be provided on the layer of material with high melting point W, in order to prevent its evaporation and/or oxidation.

Figure 13:
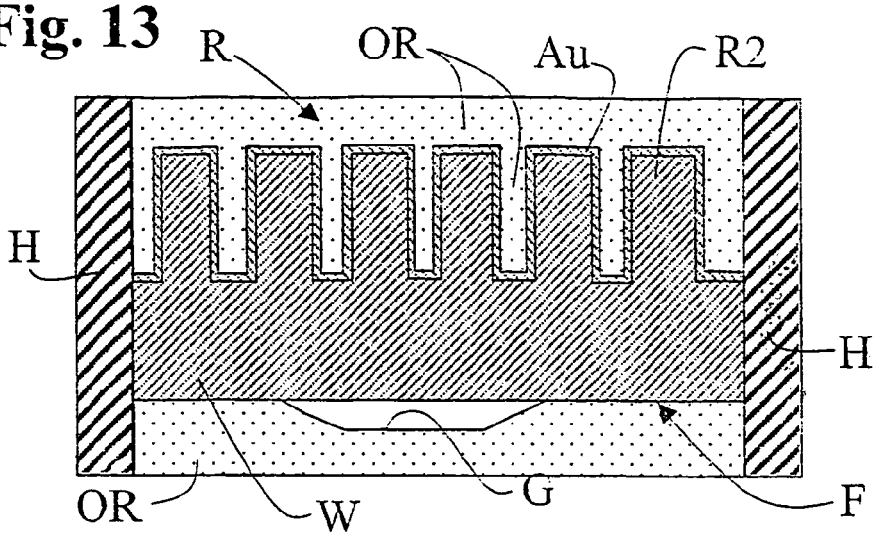
FIG. 13 is a schematic representation of an emitter according to the invention formed by a nanostructured support (W) which is coated by a thin layer (Au) of material, not necessarily with high melting point, such as gold, silver, copper, and by at least an upper encapsulating layer constituted by a refractory oxide (OR)

Both in the configuration of FIG. 13 and in that of FIG. 14 the electrical current is transported both by the material with high melting point W and by the material with low melting point Au.

Figure 15:
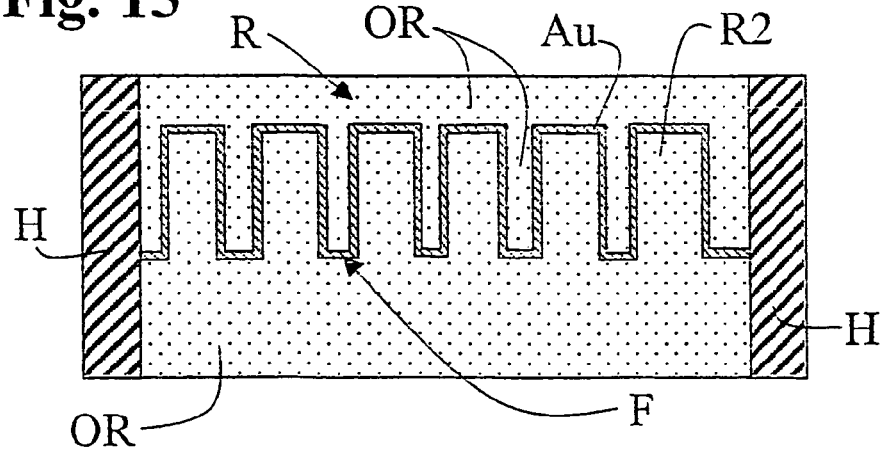
FIG. 15 is a schematic representation of an emitter according to the invention in which the nanostructure grating is obtained on refractory oxide (OR), and said grating is superficially coated by a layer (Au) of material with low melting point, such as gold, silver, copper, the layer with low melting point being in turn coated by an additional layer of refractory oxide.

In an additional preferred configuration, shown in FIG. 15, the micro-structure R can be obtained directly on a layer of refractory oxide OR; on the layer OR in which the structure R is formed is provided a thin, uniform coating of conductor or semiconductor material with low melting point, such as gold, designated by the reference Au; the layer Au obtained on the microstructure R formed in the oxide OR serves here directly as an emitter or carrier of electrical current; a second layer of refractory oxide OR which coats the layer Au allows to preserve the shape of the structure under conditions of operating temperature exceeding the melting temperature of the layer with low melting point.

Naturally, without altering the principle of the invention, the construction details and the embodiments may vary widely relative to what is described and illustrated, purely by way or example, herein, without thereby departing from the scope of the present invention.

The emitter F described herein can be used to obtain incandescent light sources of various kinds, and in particular for the production of motor vehicle lighting devices. The invention is also suitable for application for the purpose of obtaining planar matrix of micro-sources of incandescent light, where the each of the latter is provided with a respective filament or emitter in accordance with the invention.

The invention claimed is:

1. An incandescence emitter for incandescence light sources, comprising an emitter body (F) to be brought to incandescence at an operating temperature by means of passage of electric current, the emitter body (F) extending between two electrodes (H), wherein on at least one surface of the emitter body (F) a micro-structure (R) is provided, operative to enhance absorbance for wavelengths belonging to the visible region of the spectrum, wherein said micro-structure (R) is at least partly made of a first material (Au) whose melting temperature is lower than the operating temperature of the emitter body (F), said electrodes (H) are made of a second material having a high melting point, such as tungsten, at least a substantial portion of the emitter body (F), including said micro-structure (R), is coated with a coating layer (OR) made of an oxide with high melting point, such as a refractory oxide, said oxide being configured to preserve a profile of said microstructure (R) in case of melting of the first material (Au), consequent to the use of the emitter body (F) at an operating temperature exceeding the melting temperature of said first material (Au), and wherein at least one of said emitter body (F), said electrodes (H) and said coating layer (OR) includes one throat or cavity (G) being open on the first material (Au) for receiving part of said first material (Au) in case of melting thereof.

2. An emitter as claimed in claim 1, wherein said throat or cavity (G) is defined in at least one of said electrodes (H), at an interface region thereof between the first material (Au) and the second material.

3. An emitter as claimed in claim 1, wherein said throat or cavity (G) is defined in said first layer (OR), at an interface region thereof between the first material (Au) and the oxide.

4. An emitter as claimed in claim 1, wherein said first material (Au) is selected from among conductor, semiconductor and composite materials.

5. An emitter as claimed in claim 1, wherein the emitter body (F) is formed by at least a first layer of conductor material (W), melting at higher temperature than the operating temperature of the emitter body (F), such as tungsten, and by a second layer made of the first material (Au), said second layer forming said microstructure (R), and said throat or cavity (G) is defined in said first layer, at an interface region between the conductor material (W) of the first layer and the first material (Au) of the second layer.

6. An emitter as claimed in claim 1, wherein said microstructure (R) is at least partly formed with a material selected from among gold, silver and copper.

7. An emitter as claimed in claim 1, wherein said a coating layer (OR) is made of a refractory oxide (OR) selected from among ceramic base oxides, thorium, cerium, yttrium, aluminium or zirconium oxide.

8. An emitter as claimed in claim 1, wherein said microstructure (R) is formed by a superficial micro-structure of the emitter body (F).

9. An emitter as claimed in claim 1, wherein said microstructure comprises a diffraction grating (R), having at least one of a plurality of micro-projections (R1, R2) and a plurality of micro-cavities (C), where the dimensions (h, D) of the pillar-like micro-projections (R1, R2) or the micro-cavities (C) and the period (P) of the grating (R) are such to enhance emission of visible electromagnetic radiation from the first material (Au)), and/or reduce emission of infrared electromagnetic radiation from the first material (Au), and/or enhance emission of infrared electromagnetic radiation from the first material (Au) to a lesser extent with respect to the increase in visible emissivity.

10. An emitter as claimed in claim 1, wherein said microstructure (R) is binary, i.e. with two levels.

11. An emitter as claimed in claim 1, wherein said microstructure (R) is multi-level, i.e. it has a projection with more than two levels.

12. An emitter as claimed in claim 1, wherein said microstructure (R) has a continuous projection.

13. An emitter as claimed in claim 1, wherein it operates at a lower temperature than the melting point of the refractory oxide (OR).

14. An emitter as claimed in claim 1, wherein it is configured as a filament or planar plate structured under the wavelength of visible light, and in that said micro-structure (R) is a two-dimensional grating of absorbing material (k>1).

15. An incandescent light source, comprising an incandescence light emitter body brought to incandescence by the passage of electric current, wherein said incandescence light emitter body (F) is as claimed in claim 1.

16. An emitter as claimed in claim 2, wherein the emitter body (F) is almost completely coated by said coating layer (OR) with the exception of respective interface regions between the first material (Au) and the second material of said electrodes (H).

17. An emitter as claimed in claim 9, wherein said grating (R) is obtained with a first layer made of a conductor material (W) melting at higher temperature than the operating temperature of the emitter body (F), the conductor material of the first layer having a structured part, a second layer made of the first material (Au), which covers at least the structured part of said first layer, the first material (Au) being selected among conductor, semiconductor or composite materials, where the second layer (Au) copies the profile of the structured part of the first layer, to form therewith said grating (R), and the first material (Au) has a greater emission efficiency than the conductor material (W) of the first layer, said efficiency being defined as the ratio between the fraction of visible radiation emitted at the operating temperature in the interval 380 nm-780 nm and the fraction of radiation emitted at the same temperature in the interval 780 nm-2300 nm.

18. An emitter as claimed in claim 9, wherein said grating (R) is obtained on the surface of a layer (Au) made of the first material (Au), said layer made of the first material (Au) is placed on a second conductor material (W) whose melting point is higher than the operating temperature of the emitter body (F), where the first material (Au) has higher emission efficiency than the second conductor material (W), said efficiency being defined as the ratio between the fraction of visible radiation emitted at the operating temperature in the interval 380 nm-780 nm and the fraction of radiation emitted at the same temperature in the interval 380 nm-2300 nm.

19. An emitter as claimed in claim 9, wherein said grating (R) is obtained with a first layer of refractory oxide (OR) having a structured part, a second layer made of the first material (Au) which covers at least the structured part of the first layer of refractory oxide (OR), the first material (Au) being selected among conductor, semiconductor or composite materials, where the second layer made of the first material (Au) copies the profile of the structured part of the first layer of refractory oxide (OR), to form therewith said grating (R), and where the second layer made of the first material (Au) is in turn coated by an encapsulating layer constituted by refractory oxide (OR).

20. An emitter as claimed in claim 9, wherein the periodicity of the micro-projections (R1, R2) or of the micro-cavities (C) is of the order of the wavelength of visible radiation.

21. An emitter as claimed in claim 9, wherein the periodicity of the micro-projections (R1, R2) or of the micro-cavities (C) is between 0.2 and 1 micron.

22. An emitter as claimed in claim 9, wherein the height or depth of the micro-projections (R1, R2) or of the micro-cavities (C) is between 0.2 and 1 micron.

23. A method for constructing an incandescence light emitter to be brought to incandescence by passage of electric current, comprising the steps of:

a) obtaining a filiform or laminar emitter body (F) to be brought to incandescence at an operating temperature by means of passage of electric current, the emitter body (F) being formed to have on at least one surface thereof a micro-structure (R) operative to enhance absorbance for wavelengths belonging to the visible region of the spectrum, said micro-structure (R) being at least partly made of a first material (Au) whose melting temperature is lower than the operating temperature of the emitter body (F), b) obtaining a first and a second electrode (H), said electrodes (H) being made of a second material having a high melting point, such as tungsten, c) connecting each electrode (H) to the emitter body (F), and d) coating the emitter body (F) in which the anti-reflection micro-structure (R) has been formed with a coating layer (OR) of refractory oxide, said coating layer (OR) being operative to preserve a profile of said microstructure (R) in case of melting of the material (Au) thereof, consequent to the use of the emitter (F) at an operating temperature exceeding the melting temperature of said material (Au), the method including forming in at least one of said emitter body (F), said electrodes (H) and said coating layer (OR) one throat or cavity (G) open on the first material (Au).

24. A method as claimed in claim 23, wherein step b) comprises forming said throat or cavity (G) in at least one of said electrodes (H), and step c) comprises connecting said one electrode (H) and said body (F) such that at an interface region between the first material (Au) and the second material said throat or cavity (G) is open on the first material (Au).

25. A method as claimed in claim 23, wherein step d) comprises forming said throat or cavity (G) in said coating layer (OR) such that at an interface region between the first material (Au) and the refractory oxide said throat or cavity (G) is open on the first material (Au).

26. A method as claimed in claim 23, wherein step a) comprises forming the emitter body (F) by at least a first layer of conductor material (W), melting at higher temperature than the operating temperature of the emitter body (F), such as tungsten, and by a second layer made of the first material (Au), and defining said throat or cavity (G) in said first layer of conductor material (W) such that at an interface region between the first material (Au) and the conductor material (W) said throat or cavity is open on the first material (Au).

27. An incandescence emitter for incandescence light sources, comprising an emitter body (F) to be brought to incandescence at an operating temperature by means of passage of electric current, wherein on at least one surface of the emitter body (F) a micro-structure (R) is provided, operative to enhance absorbance for wavelengths belonging to the visible region of the spectrum, wherein said micro-structure (R) is at least partly made of a material (Au) whose melting temperature is lower than the operating temperature of the emitter body (F), and at least a substantial portion of the emitter body (F), including said micro-structure (R), is coated with an oxide with high melting point (OR), such as a refractory oxide, said oxide being configured to preserve a profile of said microstructure (R) in case of melting of the respective material (Au), consequent to the use of the emitter body (F) at an operating temperature exceeding the melting temperature of said material (Au).

* * * * *